US009072412B2

(12) United States Patent
Ciavarella et al.

(10) Patent No.: US 9,072,412 B2
(45) **Date of Patent: *Jul. 7, 2015**

(54) PULL ACTUATED FOAM PUMP

(75) Inventors: Nick E. Ciavarella, Seven Hills, OH (US); David D. Hayes, Wooster, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/405,956

(22) Filed: Feb. 27, 2012

(65) Prior Publication Data

US 2012/0160879 A1 Jun. 28, 2012

Related U.S. Application Data

(62) Division of application No. 12/474,819, filed on May 29, 2009, now Pat. No. 8,313,008.

(60) Provisional application No. 61/130,191, filed on May 29, 2008.

(51) Int. Cl.

| | |
|---|---|
| ***B67D 7/70*** | (2010.01) |
| ***A47K 5/14*** | (2006.01) |
| ***B05B 7/00*** | (2006.01) |
| ***B05B 11/00*** | (2006.01) |

(52) U.S. Cl.

CPC ..... *A47K 5/14* (2013.01); *B05B 7/0037* (2013.01); *B05B 11/3047* (2013.01); *B05B 11/3052* (2013.01); *B05B 11/3074* (2013.01); *B05B 11/3087* (2013.01); *B05B 11/3097* (2013.01)

(58) Field of Classification Search

CPC ..... B05B 11/3047; B05B 11/3074; B05B 11/3097; B05B 11/3052; B05B 11/3087; B05B 7/0037; A47K 5/14

USPC ..... 222/135, 137, 181.3, 190, 207, 325, 222/181.1; 239/319–323, 329, 330, 343, 239/345

See application file for complete search history.

(56) References Cited

U.S. PATENT DOCUMENTS

| | | | |
|---|---|---|---|
| 4,330,071 | A | 5/1982 | Ohlson |
| 4,880,161 | A | 11/1989 | Wright |
| 4,957,218 | A | 9/1990 | Ford, Jr. |

(Continued)

FOREIGN PATENT DOCUMENTS

| | | | |
|---|---|---|---|
| CA | 2465055 | | 6/2005 |
| EP | 1719441 | A1 | 11/2006 |

(Continued)

OTHER PUBLICATIONS

European Search Report and Opinion Dated Sep. 25, 2009 in Related EP Application No. 09161415.6.

*Primary Examiner* — Jason Boeckmann

(74) *Attorney, Agent, or Firm* — Calfee, Halter & Griswold LLP

(57) ABSTRACT

A foam dispenser having an actuator and a dispenser housing. The actuator releasably mates with a pomp of a refill unit and is moveable from a first position to a second position. Wherein the second position is further from the refill unit than the first position. Movement of the actuator from the first position to the second position causes the foam dispenser to dispense foam when a refill unit is inserted in the foam dispenser.

19 Claims, 4 Drawing Sheets

(56) References Cited

U.S. PATENT DOCUMENTS

| | | | | |
|---|---|---|---|---|
| 4,964,544 | A | 10/1990 | Hanna et al. | |
| 4,993,600 | A | 2/1991 | Tucker et al. | |
| 5,037,006 | A | 8/1991 | Kock | |
| 5,222,633 | A | 6/1993 | Blake | |
| 5,282,552 | A | 2/1994 | Ophardt | |
| 5,339,988 | A | 8/1994 | Palmer et al. | |
| 5,398,845 | A | 3/1995 | Meyer | |
| 5,411,177 | A | 5/1995 | Blake, III | |
| 5,445,288 | A | 8/1995 | Banks | |
| 5,544,788 | A | 8/1996 | Meyer | |
| 5,676,277 | A | 10/1997 | Ophardt | |
| 5,725,131 | A | 3/1998 | Bell et al. | |
| 5,752,627 | A | 5/1998 | Vandromme et al. | |
| 5,779,104 | A * | 7/1998 | Reidel | 222/190 |
| 5,810,204 | A | 9/1998 | Devlin et al. | |
| 5,862,954 | A | 1/1999 | Ehrensperger et al. | |
| 5,906,299 | A | 5/1999 | Hagleitner | |
| 5,944,070 | A | 8/1999 | Schmidt et al. | |
| 5,984,146 | A | 11/1999 | Kaufman | |
| 6,082,586 | A * | 7/2000 | Banks | 222/190 |
| 6,082,593 | A | 7/2000 | Borcherds | |
| 6,138,878 | A | 10/2000 | Savage et al. | |
| 6,409,050 | B1 | 6/2002 | Ophardt | |
| 6,540,157 | B2 | 4/2003 | Ophardt | |
| 6,601,736 | B2 | 8/2003 | Ophardt et al. | |
| 6,612,468 | B2 | 9/2003 | Pritchett et al. | |
| 6,626,332 | B2 | 9/2003 | Ehrensperger et al. | |
| 6,644,519 | B2 | 11/2003 | Last | |
| 6,837,402 | B2 | 1/2005 | Cardia | |
| 6,923,346 | B2 | 8/2005 | Foster et al. | |
| 7,004,356 | B1 | 2/2006 | Sayers | |
| 7,063,239 | B2 | 6/2006 | Niada | |
| 7,066,357 | B2 | 6/2006 | Ciavarella et al. | |
| 7,156,260 | B2 | 1/2007 | Hayduk | |
| 7,222,753 | B2 | 5/2007 | Hayduk | |
| 7,225,948 | B2 | 6/2007 | Ophardt et al. | |
| 7,246,723 | B2 | 7/2007 | Santagiuliana | |
| 7,267,251 | B2 * | 9/2007 | Ophardt | 222/321.9 |
| 7,278,554 | B2 | 10/2007 | Armstrong | |
| 7,299,950 | B2 | 11/2007 | Laveault et al. | |
| 7,303,099 | B2 | 12/2007 | Ophardt | |
| 7,325,704 | B2 | 2/2008 | Kasting | |
| 7,337,930 | B2 | 3/2008 | Ophardt et al. | |
| 2004/0084481 | A1 | 5/2004 | Foster et al. | |
| 2005/0072805 | A1 | 4/2005 | Matthews | |
| 2005/0224519 | A1 | 10/2005 | Law et al. | |
| 2005/0247735 | A1 | 11/2005 | Muderlak et al. | |
| 2006/0175353 | A1 | 8/2006 | Ophardt et al. | |
| 2006/0273114 | A1 | 12/2006 | Ophardt | |
| 2007/0023454 | A1 | 2/2007 | Ophardt | |
| 2007/0051748 | A1 | 3/2007 | Yates et al. | |
| 2007/0215643 | A1 | 9/2007 | Law et al. | |
| 2007/0251953 | A1 | 11/2007 | Criswell et al. | |
| 2008/0083783 | A1 | 4/2008 | Nelson | |
| 2008/0083784 | A1 | 4/2008 | Foster et al. | |
| 2009/0184137 | A1 | 7/2009 | O'Brien | |

FOREIGN PATENT DOCUMENTS

| | | |
|---|---|---|
| GB | 2437510 A | 10/2007 |
| WO | 99/49769 | 10/1999 |

* cited by examiner

PULL ACTUATED FOAM PUMP

PRIORITY STATEMENT

This application is a divisional application of U.S. patent application Ser. No. 12/474,819 filed on May 29, 2009 and claims the benefits of and priority to U.S. patent application Ser. No. 12/474,819 and U.S. Provisional Application No. 61/130,191 filed May 29, 2008, which are incorporated herein by reference.

FIELD OF THE INVENTION

The invention herein resides in the art of foam dispensers wherein a foamable liquid and air are combined to dispense a foam product. More particularly, the invention relates to a foam dispenser wherein a liquid pump is provided as part of a disposable refill unit containing the liquid, and an air pump is provided as part of the dispenser housing. This invention further relates to a refill unit having a liquid pump that is actuated upon a pull stroke.

BACKGROUND OF THE INVENTION

Most wall mounted soap dispensers include a housing, which is adapted to retain a refill unit including a container of soap and associated pump mechanisms that dispense soap through a dispensing spout upon their actuation. The housing is mounted to a wall, and the pump mechanisms are actuated through movement of a push bar pushed toward the wall. The dispensing spout is located between the push bar and the wall such that the push bar moves in a lateral direction closer to the dispensing spout upon actuation of the pump mechanisms. The dispensing spout also typically moves upwardly during actuation, thus raising the dispensing spout vertically relative to the push bar. Because of this relative movement between the push bar and the dispensing spout, the push bar sometimes collects soap during dispensing. This is particularly problematic when a foamed soap is dispensed, because the foam stream exiting the dispensing spout tends to spread in width and flutter side-to-side due to the physical forces acting to create the foam and the properties of the foam itself. Soap left on the push bar can grow germs that can come into contact with the end user or dispenser serviceman.

It is somewhat common to modify the shape of the push bar to prevent the push bar from getting too close to the erratic path of the foamed soap, but such modifications can increase dispenser production costs and limit the industrial design options for the push bar shape. Thus, a need exists for a pump mechanism that is actuated in a manner that reduces, and preferably eliminates, the tendency for soap to collect on the push bar of the dispenser.

The refill unit, which includes a container of product to be dispensed and an associated pump that is actuated to dispense the product, typically carries a reciprocating piston pump, wherein a piston member of the pump reciprocates relative to stationary portions of the pump in order to trap a fixed amount of the product and then displace that trapped volume into and out of the dispensing tube. In order to reduce the overall footprint of the refill unit, the stationary portions of these reciprocating piston pumps often extend into the container of the refill unit. As a result, the volume of product that can be carried by the container is reduced by the volume occupied by elements of the pump. Additionally, because these pumps must have an inlet communicating with the product in the container in order to draw the product into the pump, either product is wasted when the level of the product falls below the inlet to the pump or special adaptations must be made to place the inlet to the pump at a position where the vast majority of the contents of the container can be drawn into the pump. For instance, in some refill units, a dip tube of the reciprocating piston pump is curved 180° to place the inlet of the dip tube near the bottom of the refill container. In others, a shroud is employed to the same effect, the shroud having a conduit communicating with the lower regions of the container. While this helps to ensure that less product is wasted, the extension of pump mechanisms into the container volume decreases the amount of product that the container can carry. Thus, there is a need in the art to maximize the useful volume of a container by decreasing the amount of wasted space within the volume of the container, thus maximizing the amount of product that the container can hold.

The volume occupied by a refill unit is also a consideration for shipping purposes. For purposes of shipping product, it is important to maximize the amount of product that can be shipped in a given shipment. Thus, there is a need in the art to increase the useful volume of a refill unit while maintaining an acceptable shipment volume of the refill unit.

Typically, foam pumps provided as part of a soap dispenser refill unit include an air pump portion and a liquid pump portion integrated together. The refill unit will carry a foam pump comprised of an air pump portion and a liquid pump portion, and the dispenser housing will carry elements for retaining the refill unit and elements for actuating the foam pump. It has been found that providing the air pump portion as part of the foam pump carried by the refill unit is not necessarily cost effective. The air pump portion adds to the size, weight and cost of the refill unit, especially in high output dispensers. Accordingly, there is also a need in the art for foam dispensing systems that employ a disposable liquid pump portion, as part of a refill unit, and a more permanent air pump, as part of a dispenser housing.

SUMMARY OF THE INVENTION

In accordance with an embodiment of this invention, a refill unit is provided for a dispenser. The refill unit includes a container holding liquid and a pump secured to the container. The pump includes a piston housing secured to the container, and a piston assembly is received in the piston housing so as to reciprocate between a non-actuated position and an actuated position relative thereto, the movement from the non-actuated position to the actuated position serving to dispense the liquid at an outlet of the pump, wherein the piston assembly is moved from the non-actuated position to the actuated position by being pulled in a direction away from the container.

In accordance with another embodiment of this invention a dispenser is provided having a dispenser housing that selectively receives a refill unit. The refill unit includes a container holding a liquid, the container including a neck extending from a shoulder. The container is received in the housing with the neck positioned below the shoulder. The refill unit also includes a piston housing secured to the container at the neck and extending into the neck to provide an inner wall defining a passageway communicating with the liquid in the container at an inlet end thereof, the inlet end being positioned within the neck such that the piston housing does not extend beyond the shoulder, thus permitting liquid to occupy at least a portion of the neck. The refill unit further includes a piston assembly received by the piston housing so as to reciprocate between a non-actuated position and an actuated position relative thereto to dispense the liquid, wherein the piston assembly does not extend beyond the shoulder, thus permitting liquid to occupy at least a portion of the neck.

In accordance with an embodiment of this invention a foam dispenser is provided having a dispenser housing that selectively receives a refill unit. The dispenser includes a collapsible air chamber mounted to the dispenser housing and includes an air outlet, the collapsible air chamber having an expanded volume and a compressed volume. The refill unit includes a container, a piston housing, a piston assembly, a liquid chamber seal, a premix chamber, and a mesh screen. The piston housing is secured to the container and provides an inner wall defining an axial passageway having an inlet end communicating with liquid held in the container. The piston assembly is received by the piston housing so as to reciprocate between a non-actuated position and an actuated position relative thereto. The piston assembly includes a liquid piston that reciprocatingly fits within the axial passageway of the piston housing, and a piston head extends from the liquid piston and sealingly engages the inner wall of the piston housing. The liquid chamber seal extends between the liquid piston and the inner wall of the piston housing, and the liquid piston, the piston head, the inner wall and the seal define an annular collapsible liquid chamber having an expanded volume and a compressed volume. Positioning the refill unit in the dispenser housing forms an extrusion chamber, and the air outlet of the collapsible air chamber communicates with the extrusion chamber. The premix chamber communicates with the extrusion chamber through extrusion passages. When the piston assembly is moved from the non-actuated position to the actuated position, the annular collapsible liquid chamber is compressed from its expanded volume to its compressed volume, such that liquid therein is advanced to the extrusion chamber; the collapsible air chamber is compressed from its expanded volume to its compressed volume, such that air is advanced to the extrusion chamber to mix with liquid therein; and air and foamable liquid mixed at the extrusion chamber are advanced to the premix chamber through the extrusion passages, with the advancement therethrough further mixing the air and foamable liquid to create a coarse foam, wherein the coarse foam is advanced through the mesh screed to create a more homogenous foam.

DETAILED DESCRIPTION OF ILLUSTRATIVE EMBODIMENTS

Figure 1:
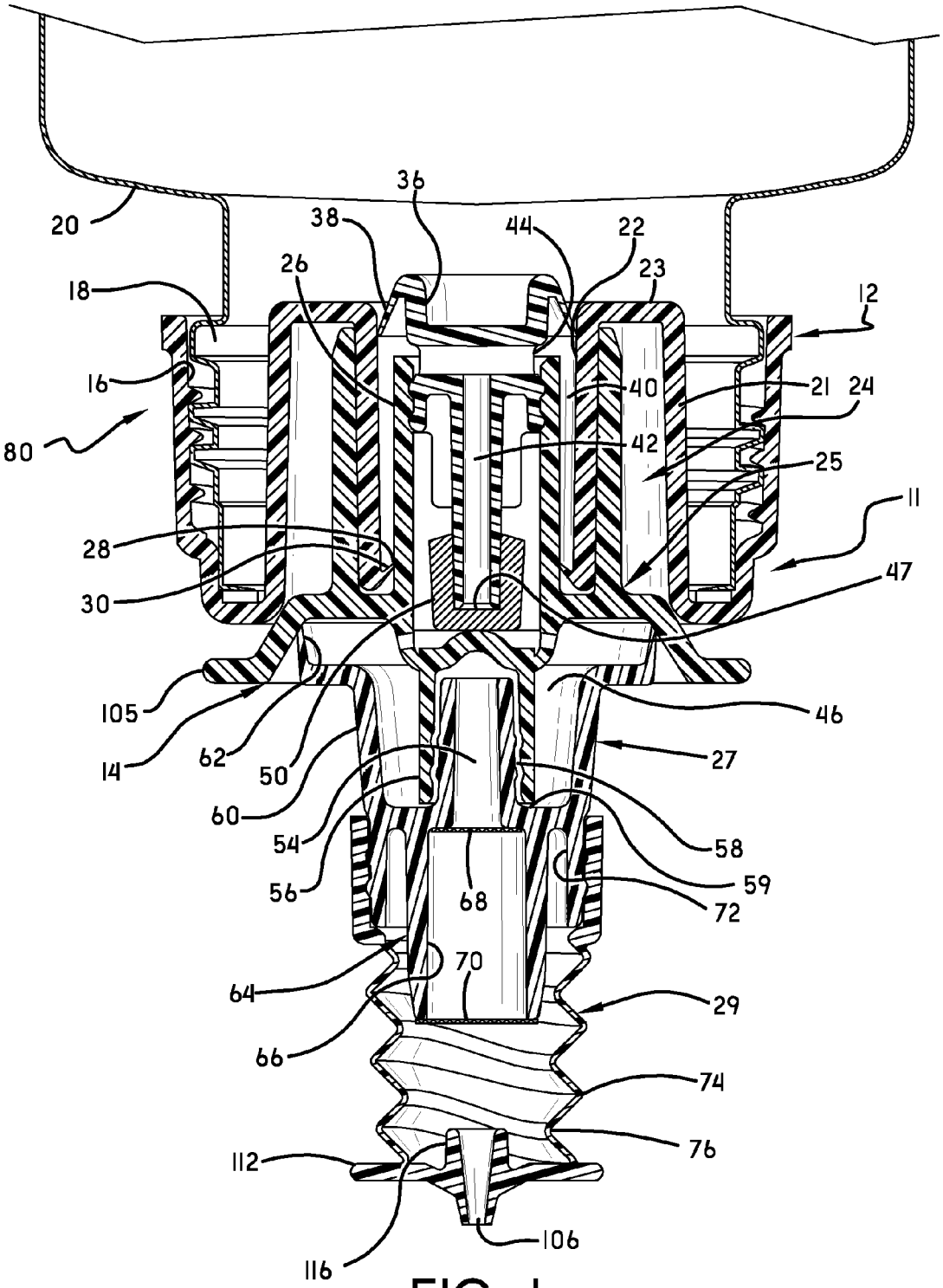
FIG. 1 is a cross sectional view of a liquid pump portion of a pull actuated foam pump in accordance with this invention.
Figure 2:
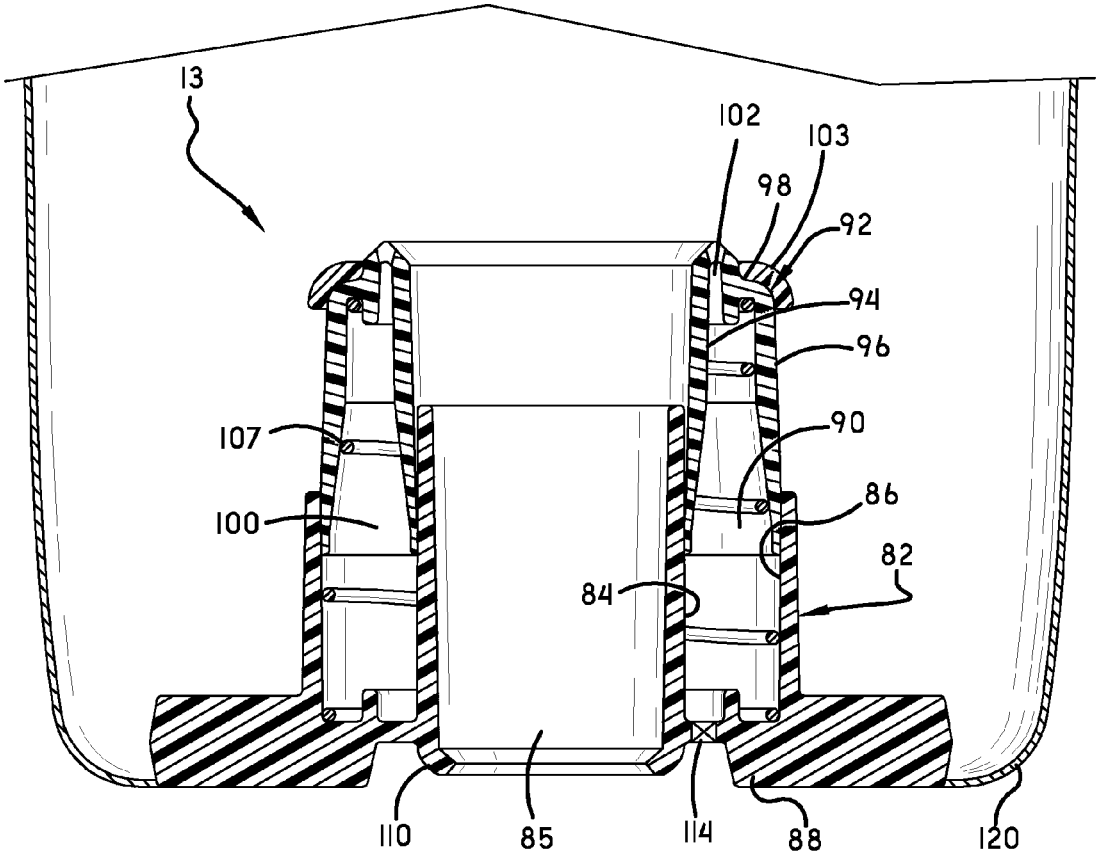
FIG. 2 is a cross sectional view of an air pump portion of a pull actuated foam pump in accordance with this invention.
Figure 3:
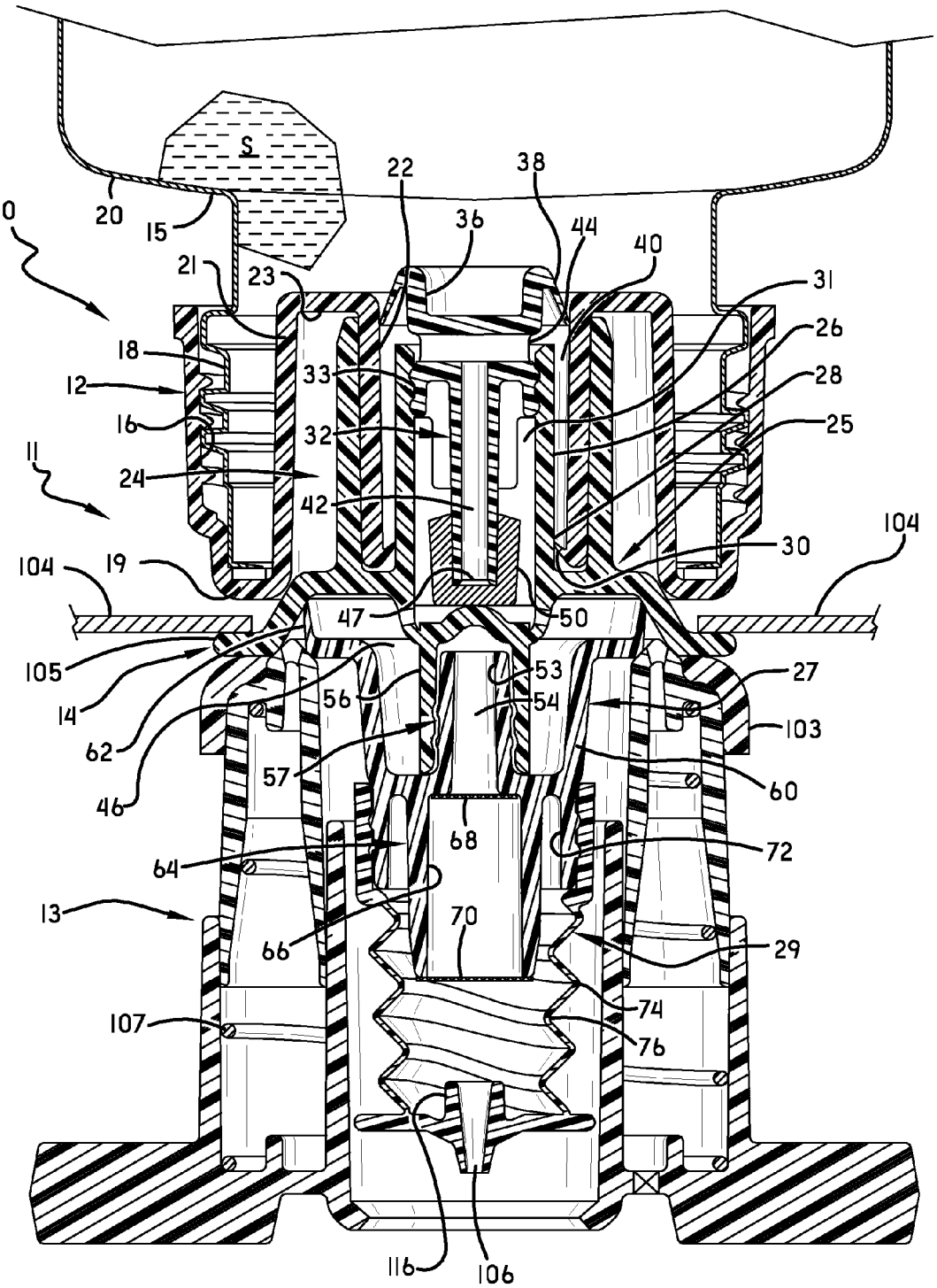
FIG. 3 shows the joiner of the liquid pump portion of FIG. 1 and the air pump portion of FIG. 2, and, as such, is a cross sectional view of a pull actuated foam pump in accordance with this invention, shown at a rest position and charged for subsequent actuation to dispense a foam product.
Figure 4:
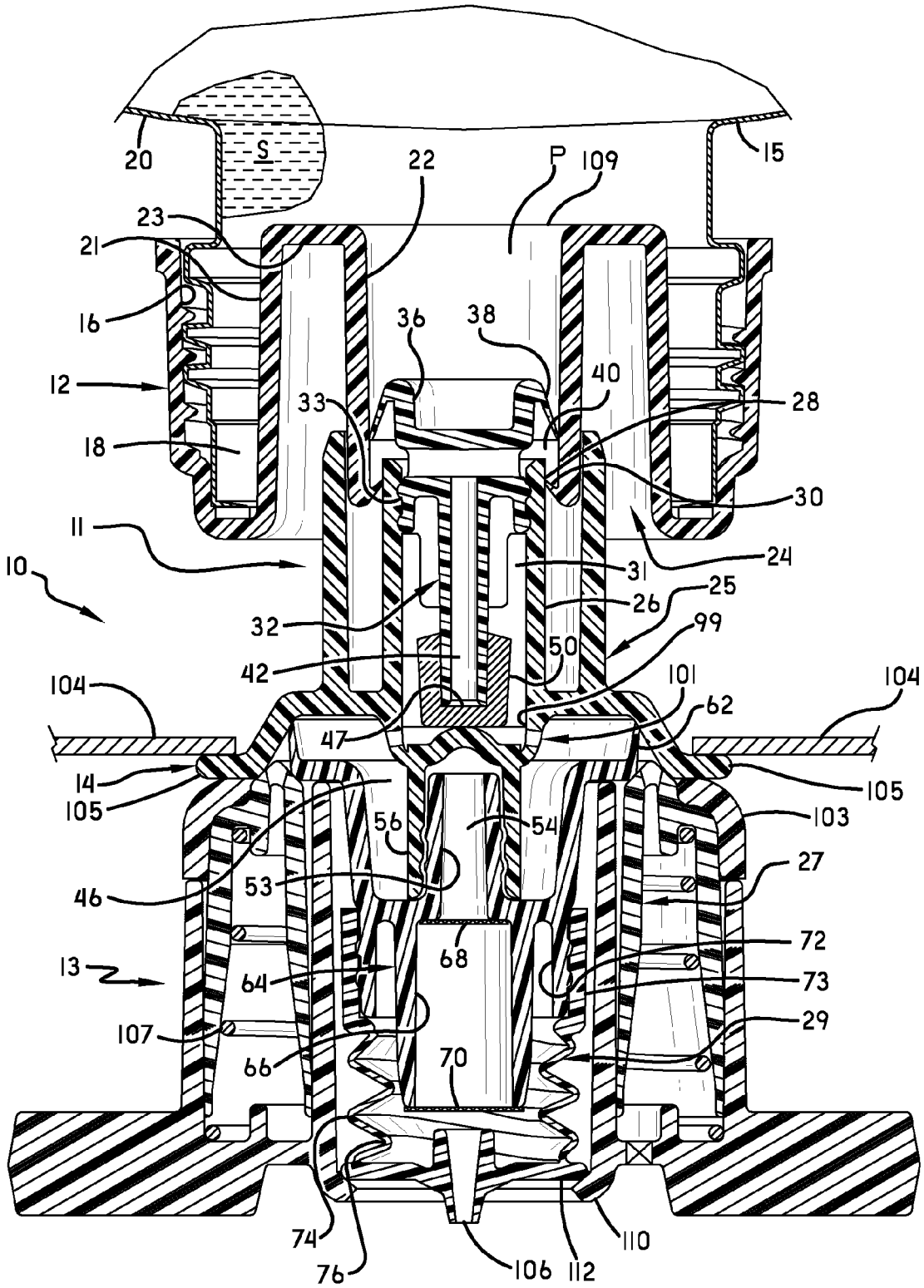
FIG. 4 is a cross sectional view as in FIG. 3, but with the foam pump moved to an actuated position.

Referring to FIGS. 1-3, a foam pump 10 (FIG. 3) in accordance with this invention is shown as including a liquid pump portion 11 (FIG. 1) and an air pump portion 13 (FIG. 2). The liquid pump portion 11 is first considered, and includes a piston housing 12, which is joined with a piston assembly 14 such that the piston assembly 14 can selectively reciprocate relative to the piston housing 12, between a rest position (FIG. 3) and an actuated position (FIG. 4), with the understanding that FIG. 4 shows the pump 10 in a fully actuated position, and the pump 10 is actuated upon the initiation or movement from the position of FIG. 3 toward the position of FIG. 4. The piston housing 12 communicates with a source of a foamable liquid, and the pump 10 is actuated to mix the foamable liquid with air and dispense it as foam. In this embodiment, the piston housing 12 includes a threaded sidewall 16 that mates with a threaded neck 18 of a bottle 20 that carries the foamable liquid S. The piston housing 12 preferably threads onto the neck 18 and provides a rim 19 that rests flush on the rim defined at the open mouth of the neck 18. From rim 19, the piston housing 12 provides an annular channel 24 extending into the interior of the neck 18, the annular channel 24 being defined by an outer wall 21, spaced from an inner wall 22 by a base wall 23. The annular channel 24 makes the overall assembly space efficient, and the inner wall 22 defines a passageway P (FIG. 4) for receiving a portion of the piston assembly 14, as will be described more fully below. The inner wall 22 defines a boundary of a liquid chamber that receives foamable liquid S from the bottle 20, as will be described more fully below.

The piston assembly 14 includes a body portion 25, a mixing chamber unit 27, and a collapsible dispensing tube 29. The body portion 25 includes a liquid piston 26 that fits within the passageway P at the outlet end 28 proximate the wiper seal 30 extending from the inner wall 22. The term "liquid" modifies "piston" to indicate that the piston 26 serves to advance liquid. The liquid piston 26 can move within the passageway P, reciprocating between the non-actuated rest position of FIG. 3, wherein a piston head 36 is positioned closer to an inlet end 109 of the passageway P, and the actuated position of FIG. 4, wherein the piston head 36 is positioned closer to the outlet end 28. The exterior surface of the liquid piston 26 sealed against the wiper seal 30 and inset from the inner wall 22. The liquid piston 26 is generally hollow and defines a passageway 31 that receives a piston head and liquid passage assembly 32 secured within the passageway 31 at ribs and channels shown at 33. The assembly 32 includes a piston head 36 having a wiper seal 38 that is angled downwardly in the direction of movement of the piston assembly 14 from the non-actuated position to the actuated position, and engages the inner wall 22. This structure defines a collapsible liquid chamber 40 between the inner wall 22, the exterior surface of the liquid piston 26, the wiper seal 30 and the wiper seal 38.

Notably, this liquid chamber 40 is located completely within the neck 18 of the bottle 20 and does not extend past the shoulder 15, into the main body of the bottle 20. Preferably, the uppermost portion of the expanded liquid chamber 40, as defined by the contact between the wiper seal 38 and the inner wall 22 when in the non-actuated position, is recessed below the shoulder 15, thus permitting the foamable liquid S to occupy a portion of the volume of the bottle provided by the neck 18. This is a great advantage over the common reciprocating piston pumps employed, because those pumps provide substantial structures extending well beyond the shoulder 15 and thus take up space that could otherwise be occupied by the foamable liquid S, thus providing more product to the user. Additionally, the present structure permits virtually all of the liquid S within the container to be advanced through the pump, without the need for a special dip tube or other expensive structures to reach and pump liquid, such as would be needed if a volume of liquid was present below pump structures extending beyond the shoulder 15. This liquid pump portion 11 thus increases the useful volume of the bottle 20 with which it is associated.

The liquid chamber 40 collapses as the wiper seal 38 moves closer to the wiper seal 30, as the liquid piston 26 is moved from the non-actuated rest position to the fully actuated position. In the embodiment shown, the liquid chamber 40 is an annular chamber, and, similarly, the channel 24 is an annular channel, because the neck 18, the piston housing 12 and the liquid piston 26 are circular in cross section, but the various elements of the pump 10 can be otherwise shaped. Circular cross sections are typically practiced.

A liquid passage 42 extends through the liquid piston 26, communicates with the liquid chamber 40, at one or more inlets 44, and communicates with the passage 31 at an outlet 47, after passing through a liquid outlet valve 50 that covers the outlet 47. The passage 31 communicates with an extrusion chamber 46 through apertures 101 in a bracket support 99, as will be described below. In this embodiment, the liquid passage 42 is shown as a T-shaped passage, with two inlets 44 extending radially from an axial portion of liquid passage 42 that extends to outlet 47. The liquid passage 42 can take other shapes, so long as it communicates with the collapsible liquid chamber 40 and, ultimately, the extrusion chamber 46.

As appreciated in the figures, the extrusion chamber 46 is generally defined between surfaces of the body portion 25 and the mixing chamber unit 27, which is secured to the piston assembly 14 at a mounting bracket 56 provided as part of body portion 25. The mounting bracket 56 is positioned below and coaxial with the liquid piston 26, and is formed as part of the body portion 25 by bracket supports 99, which include apertures 101. The extrusion chamber 46 can be considered to be that volume defined between the surface of the mixing chamber unit 27 and the surface of the body portion 25, and it can be seen that liquid exiting outlet 47, into passage 31, would enter the extrusion chamber 46 at apertures 101.

The mixing chamber unit 27 includes a wall 53 that snap fits into the mounting bracket 56 through the interaction of ribs and channels shown at 57. The ribs and channels at 57 are discontinuous and interact to create generally annular extrusion passage 58, which is vertically oriented in this embodiment, and can be entered at a horizontal passage 59, formed generally by distancing the open end of bracket 56 from the surface of the mixing chamber unit 27. The extrusion passage 58 provides a flow path from extrusion chamber 46 to a premix chamber 54, which is defined between the wall 53, the mounting bracket 56, and an inlet mesh screen 68 of a mixing cartridge 64. As will be described more fully below, air and foamable liquid S are extruded through the extrusion passage 58 into the premix chamber 54, and this extrusion helps in the premixing of the air and foamable liquid S.

An extrusion chamber wall 60 steps outwardly and upwardly from the wall 53 and terminates at an inlet seal 62 that extends upwardly to contact the underside of an actuator flange 105 of body portion 25. The mixing chamber unit 27 includes a mixing cartridge 64 defined by a hollow tube 66 extending from the extrusion chamber wall 60 and separated from the premix chamber 54 by an inlet mesh screen 68. This hollow tube 66 is also preferably bound on its opposite end by an outlet mesh screen 70. A dispensing tube bracket 72 also extends from the extrusion chamber wall 60, around the mixing cartridge 64, to receive a connector portion 73 of the collapsible dispensing tube 29 through a snap fit (ribs and channels). In the embodiment of a liquid pump portion 11 shown here, the dispensing tube 29 is formed as a bellows, having a corrugated structure with multiple ridges 74 and valleys 76. The mixing chamber unit 27 provides air and liquid mixing elements and provides for fluid communication between the extrusion chamber 46 and the air pump portion 13 of the pump 10, so that, upon actuation of the pump 10, the extrusion chamber 46 receives air to mix with the 25 liquid received from liquid passage 42.

As seen in FIG. 1, all of the elements of the liquid pump portion 11 are provided as an assembled unit that is mated with a bottle 20 carrying foamable liquid S. By mating the liquid pump portion 11 to a bottle 20 (as at threaded sidewall 16 and threaded neck 18), a disposable refill unit 80 is created for insertion into a dispenser housing having elements for effecting the dispensing of the foamable liquid S as foam. The dispenser housing provides the air pump portion 13, which is necessary for pumping air to mix with the foamable liquid. The liquid pump portion 11 mates with the air pump portion 13 to create a complete foam pump 10.

Referring now to FIG. 2, the air pump portion 13 of the foam pump 10 is disclosed. The air pump portion 13 includes an annular piston housing 82 defined by an internal wall 84 spaced from an external wall 86 by a base wall 88. The internal wall 84 defines a central passage 85 for movement of the piston assembly relative thereto. The annular piston housing 82 provides an open end 90 that receives an annular air piston member 92 defined by an internal wall 94 spaced from an external wall 96 by a top wall 98. The receipt of the annular piston member 92 in the annular piston housing 82 creates a collapsible air chamber 100. The collapsible air chamber 100 is biased to an expanded volume by a spring 107. One or more air ports 102 are provided in the top wall 98. As shown, the air pump portion 13 is secured to or otherwise forms a part of a dispenser housing 120, and the dispenser housing 120 receives the refill unit 80, to join the liquid pump portion 11 and air pump portion 13, as seen in FIGS. 3 and 4, to complete the foam pump 10. When joined, the air ports 102 are positioned radially outward of the inlet seal 62 provided by mixing chamber unit 27. An elastomeric gasket 103 is secured to the external wall 96 of annular piston member 92, and extends to the air port 102 at top wall 98 to provide a seat for the actuator flange 105. This elastomeric gasket 103 is squeezed sufficiently upon the joining of the liquid pump portion 11 and air pump portion 13 to prevent air advanced by the air pump portion 13 from exiting where the surfaces of the liquid pump portion 11 and the air pump portion 13 meet.

Although the air pump portion 13 is shown here as a piston-type pump, it should be appreciated that other collapsible structures such as bellows or domes could be employed and appropriately associated with the piston assembly 14 to collapse and advance air through the pump as disclosed herein.

The dispenser housing 120 provides an actuator assembly 104 (Figs. That engages the actuator flange 105 and is advanced downwardly to actuate the foam pump 10 and dispense a dose of foam product at outlet 106 (FIG. 4). The annular piston housing 82 is mounted to the dispenser housing to be stationary such that the piston assembly 14 moves relative to the annular piston housing 82, as seen between FIGS. 3 and 4. In a particular embodiment, the typical push bar or electronic hands-free dispensing mechanisms in wall-mounted soap dispensers are readily adapted to advance those elements downwardly upon pushing on the push bar or tripping the sensors of a hands-free dispenser. The elements are pushed downwardly against a biasing mechanism, for example, the spring 107 in the air chamber 100. After the foam pump 10 is advanced against the biasing mechanism to the actuated position of FIG. 4, the biasing mechanism will return the foam pump 10 to its rest position of FIG. 3. As an alternative, the actuator assembly 104 could be biased and configured to grip the actuator flange 105, so as to be capable of forcing the actuator flange 104 not only downwardly, upon actuation, but upwardly upon release, when the biasing mechanism acts to return the actuator assembly 104 back to the rest position.

As the foam pump 10 is actuated, the collapsible liquid chamber 40 is forced from an expanded volume (FIG. 3) to a compressed volume (FIG. 4), and the collapsible air chamber 100 is forced from an expanded volume (FIG. 3) to a compressed volume (FIG. 4). The collapsible air chamber 100 collapses as the piston assembly 14 moves downwardly. This reduces the volume of both the collapsible liquid chamber 40 and the collapsible air chamber 100, and, as a result, air is expelled from the collapsible air chamber 100, through the air ports 102 and past the inlet seal 62 to enter the extrusion chamber 46 to mix with foamable liquid S expelled from the collapsible liquid chamber 40, through liquid passage 42, past the liquid outlet valve 50, and through the apertures 101 in support 99 to also enter the extrusion chamber 46. The liquid outlet valve 50 is a cup-shaped elastomeric piece covering the outlet 47 of the liquid passage 42, and it deforms under the pressure of the liquid being force from the collapsible liquid chamber 40 to allow liquid to pass into the passageway 31 and, from there, into extrusion chamber 46. Thus, it can be seen that the foamable liquid and air come into contact at the extrusion chamber 46 (though it should be appreciated that air might also enter passage 31). From there, they are simultaneously forced through (or extruded through) the extrusion passage 58 into the premix chamber 54. This simultaneous movement of a significant volume of air and foamable liquid through the small through passages at 58 and 59 and into the premix chamber 54 causes a turbulent mixing of the air and foamable liquid to create a coarse foam mixture. The coarse foam mixture is advanced through the mixing cartridge 64 to create a uniform, high quality foam product that is dispensed at pump outlet 106. It should be appreciated that the mixing cartridge 64 provides opposed mesh screens that function to create a high quality foam product, but a single mesh screen could be used as well, such that, in some embodiments, a mixing "cartridge" is not employed. Two mesh screens are often preferred to improve foam quality.

In FIG. 4 it can be seen that the dispensing tube 29 collapses during dispensing. Particularly, the central passage 85 has a stop flange 110 extending inwardly at its distal end, and a distal ridge 112 of dispensing tube 29 engages this stop flange 110 such that the end of the dispensing tube 29 is stopped thereby. The remainder of the piston assembly 14 continues to move toward the stop flange 110, and the dispensing tube 29 collapses.

After release of the actuating force, the return bias provided by biasing mechanism (e.g. spring 107) returns the piston assembly 14 to the rest position of FIG. 3, and the collapsible liquid chamber 40 expands, drawing liquid in past the wiper seal 38. Similarly, the collapsible air chamber 100 expands and draws air from the atmosphere through an air inlet valve 114. The dispensing tube 29 also expands, drawing air in through the outlet 106 and thereby purging it of any residual foam, which, if left in the passage, might break down to a more liquid form and drip out. Instead, the residual foam is sucked back into the dispensing tube 29. The outlet 106 is preferably formed with an outlet wall 116 extending into the interior of the dispensing tube 29. This creates a barrier to flow to the outlet 106, and permits the residual foam in the dispensing tube 29 to break down and pool in the dispensing tube 29 between outlet wall 116 and tube 29, without dripping out of the outlet 106. As an alternative, the dispensing tube 29 may be mounted to the dispenser housing 120 (for example, to a push bar portion of the dispenser housing) to take a more serpentine path from connector portion 73 to outlet 106, and a portion of the tube 29 could be made to extend more horizontally such that foam drawn into tube 29 could break down and rest in the horizontal portion without a tendency to drip out the outlet 106.

The ratio of air to liquid fed to the mixing cartridge 64 can be altered by altering the size of the collapsible air chamber 100 and collapsible liquid chamber 40. In particular embodiments the collapsible air chamber 100 and collapsible liquid chamber 40 are designed so that the ratio of the volume of air to the volume of liquid fed to the mixing chamber is about 10:1. In another embodiment, the ratio is 15:1 and in another 7:1. Various ratios are acceptable, and will be found to be acceptable for a given foamable liquid formulation, and the recitation here of particular ratios is not to be construed to limit this invention.

In accordance with this invention, the pump is actuated as its piston assembly is pulled downwardly away from the liquid container, while, in the prior art, it has been common to actuate pumps by advancing a piston assembly (of a different structure) upwardly. When employed in the common wall-mounted dispenser environment particularly applicable is soap dispensing, particular advantages are realized. The pump of this invention can be provided as part of a refill unit that is fit within the housing of a wall-mounted dispenser. The housing would be adapted to receive the refill unit, and would provide an appropriate actuator assembly for moving the body portion of the pump assembly. As the common push bar is pushed inwardly relative to the dispenser housing, toward the horizontal position of the outlet of the pump, the outlet of the pump moves downwardly, toward the vertical position of the bottom of the push bar. This closes the vertical distance that the foamed soap must travel after exiting the outlet to pass the bottom of the push bar and reach the user's hand. As a result, the foam has less time to spread in width and flutter side-to-side, thus reducing and preferably eliminating the tendency for foamed soap to be deposited on the push bar.

As already mentioned, advantages are realized in that the liquid pump portion 11 does not extend beyond the shoulder 15 of the bottle 20, and thus does not occupy much of the internal volume of the bottle 20, particularly the main body thereof (Le., that portion above the shoulder in the orientation shown). This advantage is realized without need to take into account the air pump portion 13 of the pump 10, and, thus, this invention also supports providing a liquid pump portion only (non-foam pump), for example, by removing the air pump portion 13, the mixing chamber unit 27, and the bracket 56, and permitting the liquid to be dispensed at the outlet 47 of the liquid pump portion 11. A dispensing tube whether the same as or different from the dispensing tube 29 could be associated with the outlet 47 in such a non-foam pump. Thus, while a foam pump has been particularly disclosed in order to disclose the best mode and most advantageous pump, this invention also teaches advantages in a liquid pump associated with a bottle without regard to the further inclusion of an air pump portion.

In light of the forgoing, it should be evident that this invention provides improvements in the art of foam pumps. While only particularly desired embodiments have been described herein in accordance with disclosure requirements, it should be appreciated that structural aspects of this invention might be altered and yet be considered within the scope of this invention.

The invention claimed is:

1. A foam dispenser comprising:

a dispenser housing;

an actuator secured to the dispenser housing;

the actuator configured to releasably mate with a liquid pump of a refill unit, wherein the liquid pump is mated to a container that is provided as a single unit that is filled with a foamable liquid;

an air pump;

the actuator movable from a first position to a second position;

the second position being further away from the refill unit than the first position;

movement of the actuator from the first position to the second position causes a piston in the liquid pump to move downward away from the liquid inlet to pump foamable liquid out of the liquid pump, causes pressurized air from the air pump to mix with foamable liquid from the refill unit and causes the dispenser to dispense foam when a refill unit is installed in the foam dispenser.

2. The foam dispenser of claim 1 wherein the air pump is secured to the housing;

the air pump having an air passage configured to be in fluid communication with the refill unit and wherein the air passage is not open to the atmosphere when the refill unit is installed in the foam dispenser, and wherein the air pump remains with the foam dispenser when the refill unit is removed from the foam dispenser.

3. The foam dispenser of claim 2 wherein the air pump comprises a piston and an annular piston housing and the piston housing is mounted to the dispenser housing and the piston moves relative to the annular piston housing.

4. The foam dispenser of claim 2 wherein the air pump comprises a piston and a piston housing.

5. The foam dispenser of claim 2 wherein the air pump is annular and when the refill unit is installed in the foam dispenser the air pump and the liquid pump of the refill unit are coaxial.

6. The foam dispenser of claim 2 wherein the actuator is located above the air pump.

7. The foam dispenser of claim 2 further comprising a biasing member that biases the actuator upward toward the first position.

8. A foam dispenser comprising:

a dispenser housing;

a refill unit having a container and a liquid pump located below the container;

an air pump secured to the housing, wherein the air pump is in fluid communication with an outlet of the liquid pump when the refill unit containing foamable liquid is installed in the foam dispenser and the air pump remains with the foam dispenser when the refill unit is removed from the foam dispenser;

an actuator secured to the dispenser housing;

the actuator configured to releasably mate with a pump of the refill unit when the refill unit is installed in the foam dispenser;

the actuator movable along a vertical axis from a upper position to a lower position;

movement of the actuator from the upper position to the lower position moves an air piston and a liquid piston of the pump from an upper position to a lower piston and causes pressurized air to travel from the air pump to the outlet of the liquid pump and the pressurized air mixes with liquid to form a foam and the actuator causes the foam dispenser to dispense foam when the refill unit is installed into the foam dispenser.

9. The foam dispenser of claim 8 wherein the actuator is located above the top of the air pump.

10. The foam dispenser of claim 8 wherein the air pump comprises a piston pump.

11. The foam dispenser of claim 10 wherein the air pump is annular and configured to receive at least a portion of the liquid pump, which fits at least partially within the air pump when the refill unit is installed in the foam dispenser.

12. The foam dispenser of claim 10 wherein the dispenser comprises a base located at the bottom of the dispenser and the air pump is secured to the base of the dispenser housing.

13. The foam dispenser of claim 10 wherein the base of the dispenser housing includes an opening for dispensing foam and wherein the air pump at least partially encloses the opening.

14. The foam dispenser of claim 10 wherein movement of the actuator to the lower position compresses the air pump.

15. A foam dispenser comprising:

a housing and a refill unit having a container and a liquid pump connected together as a single unit, wherein the outlet of the liquid pump is lower than the inlet of the liquid pump;

the housing having a back and a base wherein the housing is configured to receive the refill unit full of a foamable liquid is removable from the housing;

an actuator configured to releasable mate with the refill unit when the refill unit is installed in the housing;

an air pump secured to the base of the housing;

the actuator moving along a vertical axis having an upper position and a lower position, wherein movement of the actuator from the upper position to the lower position compresses the air pump to force pressurized air to an outlet of the liquid pump and pulls the liquid piston downward and away from the liquid inlet to cause the liquid pump to pump liquid which mixes the pressurized air to form a foam that is dispensed from the foam dispenser.

16. The foam dispenser of claim 15 wherein the base of the dispenser housing includes an opening for dispensing foam and wherein the air pump at least partially encloses the opening.

17. The foam dispenser of claim 15 wherein the air pump is annular and configured to receive at least a portion of the liquid pump which fits at least partially within the air pump when the refill unit is installed in the foam dispenser.

18. The foam dispenser of claim 15 wherein the air pump is annular and when the refill unit is installed in the foam dispenser the air pump and the liquid pump of the refill unit are coaxial.

19. The foam dispenser of claim 15 wherein the actuator is located above the air pump.

* * * * *